United States Patent [19]

Williams

[11] Patent Number: 4,658,505

[45] Date of Patent: Apr. 21, 1987

[54] RAZOR HANDLE FOR SUPPORTING A DETACHABLE SHAVING UNIT

[75] Inventor: Anthony J. Williams, Hornchurch, England

[73] Assignee: Wilkinson Sword Limited, High Wycombe, England

[21] Appl. No.: 839,012

[22] Filed: Mar. 12, 1986

[30] Foreign Application Priority Data

Mar. 15, 1985 [GB] United Kingdom ..... 8506831

[51] Int. Cl.[4] ..... B26B 21/00

[52] U.S. Cl. ..... 30/47

[58] Field of Search ..... 30/47, 87, 85, 332, 30/338

[56] References Cited

U.S. PATENT DOCUMENTS 4,253,235 3/1981 Jacobson ..... 30/47

4,253,236 3/1981 Jacobson ..... 30/47

4,281,455 8/1981 Dixon et al. ..... 30/47

*Primary Examiner*—Douglas D. Watts

*Attorney, Agent, or Firm*—John K. Williamson

[57] ABSTRACT

A razor handle has arms (13) for supporting a shaving unit (11) for pivotal movement about a first axis parallel to the edge of the blade (or each blade) of the shaving unit. The arms are supported on the ends of a U shaped spring (16) which permits the arms to be moved forwardly together to release the shaving unit and rearwardly together to grip a fresh shaving unit and also forwardly or rearwardly independently of one another to permit the unit to tilt about a second axis transverse to the plane of the arms (13). The spring (16) also provides a biasing force to oppose pivotal movement of the unit about the first axis.

6 Claims, 6 Drawing Figures

RAZOR HANDLE FOR SUPPORTING A DETACHABLE SHAVING UNIT

BACKGROUND OF THE INVENTION

This invention relates to a razor handle for detachably supporting a shaving unit of the pivotal type. Such a unit comprises one or more blades supported in a housing. The housing which is usually of plastics material has a pair of spaced lugs located on its rearward face and formed with recesses for receiving a pair of pivot pins of a razor handle. In this way, the shaving unit is supported on the handle for pivotal movement about an axis containing said pivot pins and parallel to the cutting edge of the, or each, blade. Spring means are additionally provided on the handle for applying torque to the unit about the pivotal axis of the pins.

In known razor handles of the type referred to above, the handle further comprises a pair of spaced apart supporting arms carrying the pivot pins at their forward ends and means for urging the pivot pins away from each other against a return spring to release the unit from the pins.

The pivotal mounting of a shaving unit in the manner described above is believed to improve shaving efficiency by enabling the shaving unit, and hence the blade or blades, to follow the contours of the face or other part of the body as the razor is moved across the part being shaved, since the unit can pivot relatively to the handle.

It is known from U.S. Pat. No. 4,152,828 to provide a razor having a twin blade unit mounted on a handle by pivot mounting means which allow the blade unit to tilt about a first axis parallel to the blade edges and also to tilt about a second axis lying in a plane perpendicular to and bisecting the blade edges so that the opposite ends of the blade unit can move relatively to one another and to the handle.

A similar result is achieved by the razor described in U.S. Pat. No. 4,347,663 except that this razor utilises a blade unit holder which is itself pivoted on pivot pins parallel to the length of the unit but spaced far to the rear of the blade edges so that the desired effect of pivoting about an axis close to the blade edges is lost. Each end of the blade unit holder is independently spring mounted on the pivot pins to allow the ends of the blade unit holder to move independently toward and away from the handle.

GB-A-2,116,470 also described a razor having a blade unit mounted for pivotal movement about first and second fixed axes as in U.S. Pat. No. 4,152,828 referred to above, and in which a pair of spaced apart blade-unit supporting arms, carrying pivot pins at their forward ends, are mounted for movement in unison about the second axis.

An object of the present invention is to provide an improved razor handle of this type.

BRIEF SUMMARY OF THE INVENTION

According to the present invention there is provided a razor handle comprising a pair of co-linear oppositely-directed pivots for detachably supporting thereon a shaving unit of the pivotal type (said unit having one or more blades contained within a housing, and the housing having spaced pivot supports thereon for receiving a pair of pivots of a handle to support the shaving unit in the handle for pivotal movement about an axis containing said pivots), said handle further comprising a pair of spaced apart supporting arms carrying said pivots at the forward ends of the arms, spring means secured to the handle and connected to the rearward ends of the arms and acting on each arm independently to urge it in a rearward direction and to oppose movement of the arms away from each other, cam means engageable with the respective arms and effective in a first sense to move the arms apart against the force of said spring means in response to forward movement of the arms relative to the cam means into a unit-released position and in a second sense to permit the arms to move towards each other into a unit-locked position under the return force of said spring means in response to rearward movement of the arms, at least one abutment on the handle offset from said axis and against which the unit in the locked position is spring-biassed by said spring means, the spring means permitting the unit to move pivotally about the said axis through the pivots and also about an axis transverse to a plane containing said arms.

Preferably the spring means comprise two spaced apart resilient limbs rigidly secured at one end thereof to the handle and rigidly secured at the opposite end thereof to the respective arms.

In a preferred embodiment the resilient limbs form the sides of a U-shaped spring, and the arms are integral with the respective resilient limbs and extend in a plane inclined to the plane of the limbs. The limbs thus constitute leaf springs.

DESCRIPTION OF THE DRAWINGS

One embodiment of a razor handle in accordance with this invention will now be described by way of example with reference to the accompanying drawings in which.

DETAILED DESCRIPTION

Figure 1:
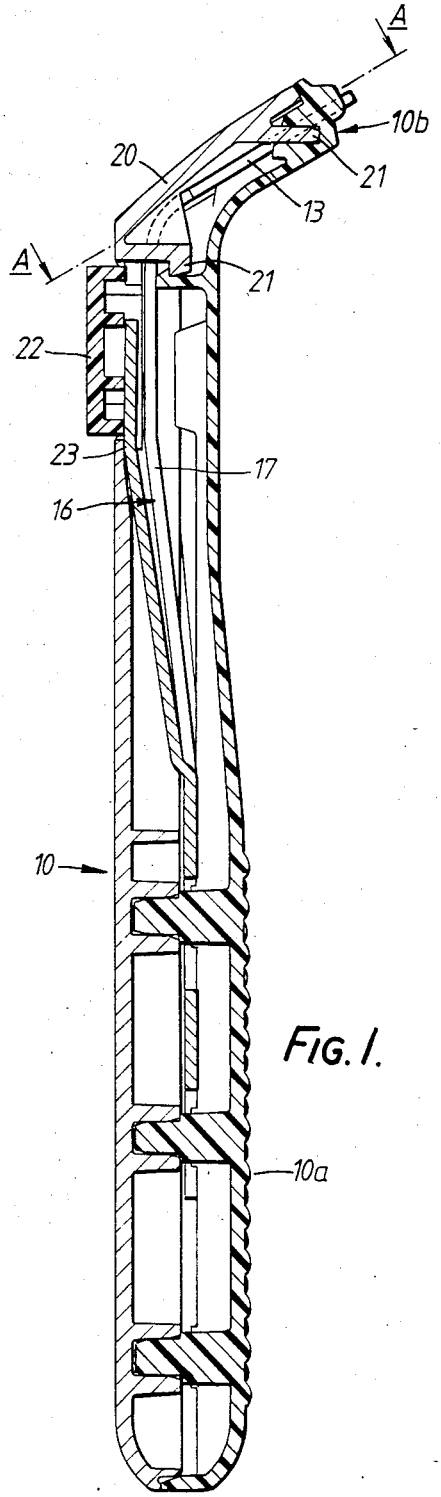
FIG. 1 is a section through the razor handle in the plane of symmetry thereof.
Figure 2:
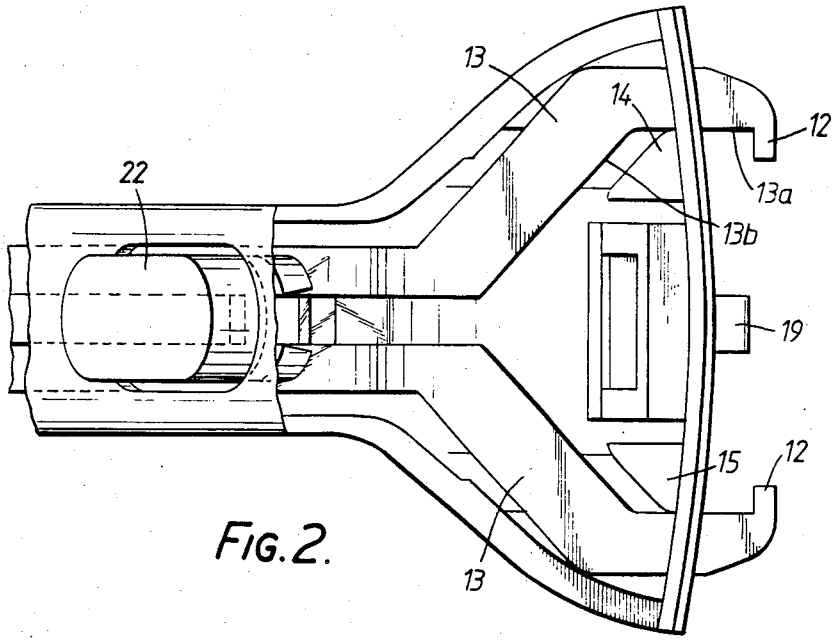
FIGS. 2 and 3 are sections in the plane A—A of FIG. 1 showing respectively the locked and released positions of blade unit supporting arms of the handle.
Figure 3:
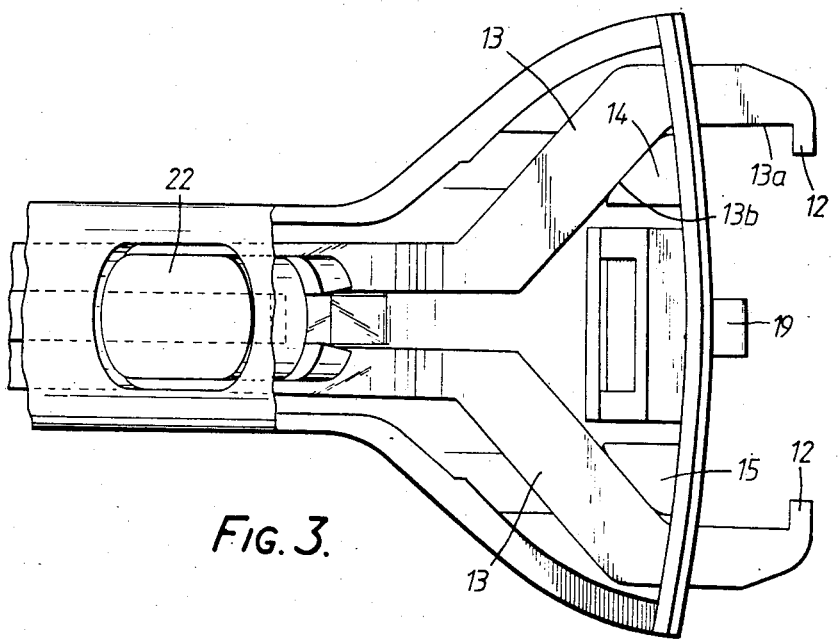
Figure 4:
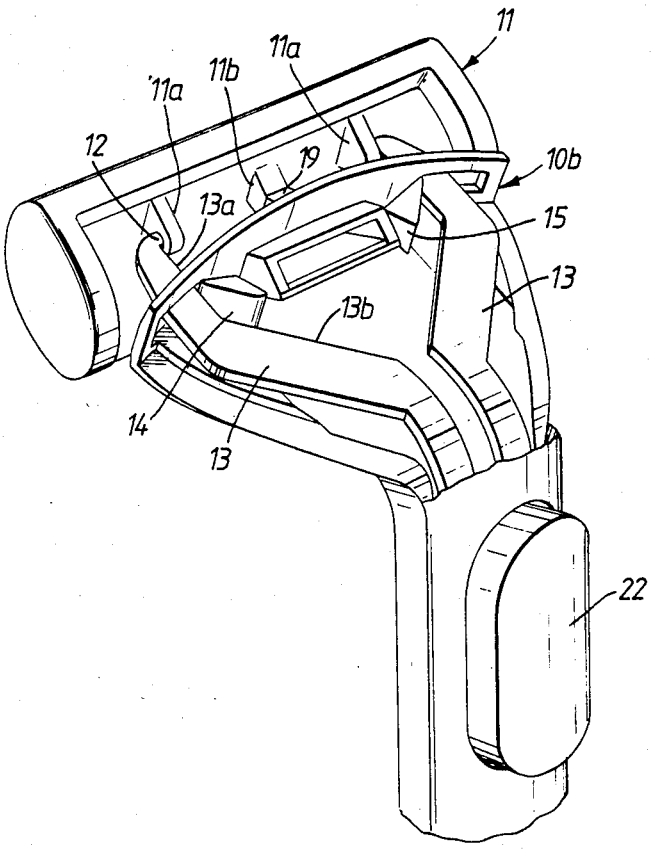
FIG. 4 is a perspective view of the handle and the blade unit supported thereon, with parts omitted for the sake of clarity.
Figure 5:
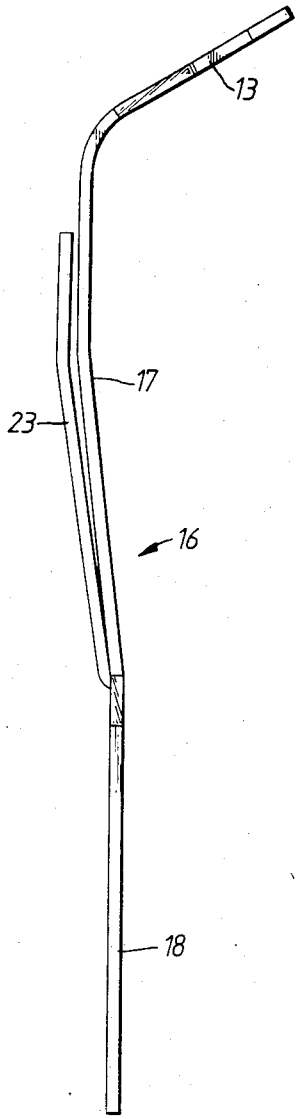
FIGS. 5 and 6 are respectively side and rear views of the U-spring by means of which the supporting arms are biassed.
Figure 6:
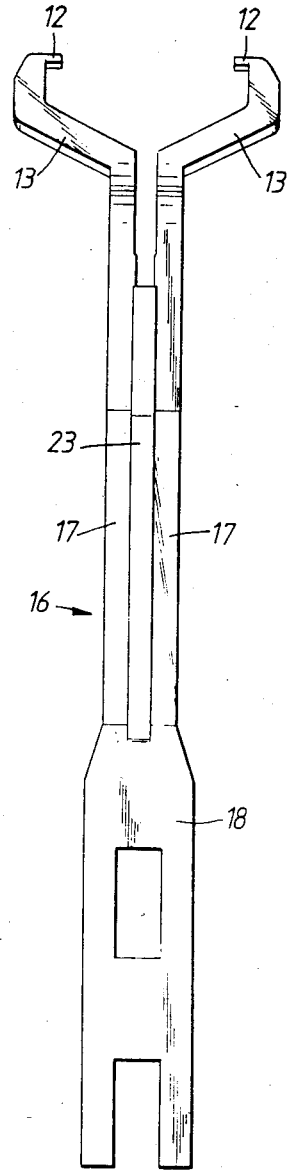

As shown in the drawings, the razor handle 10 comprises a shank portion **10*a* integral with a head portion 10*b* at its upper end. On the forward side of the head portion, a shaving unit 11, which can be of a conventional type having pivot supporting lugs 11*a*, is mounted on pivots formed by pins 12 which are integral with supporting arms 13 carried in the head portion 10*b* of the handle 10**.

The two supporting arms 13 together define the outer sides of a substantial Y shape but are cranked along their length to define cam surfaces **13*a* which extend parallel to one another and adjacent cam surfaces 13*b*** which are inclined to one another.

Mounted on the head portion **10*b* of the razor handle are cam members 14,15 which are mirror images of each other, the cam member 14,15 being contacted by the cam surfaces of the arms 13**.

Mounted within a hollow portion of the shank **10*a* of the razor is an elongate U-shaped spring 16, the limbs 17** of which are integral at their upper ends with the respective supporting arms 13. The limbs 17 are integral at their lower ends with a root portion 18 which is secured to the shank portion 10*a* but elsewhere the limbs 17 are spaced from the adjacent surfaces of the razor handle to permit flexing movement of the limbs. The spring 16 is conveniently stamped out of sheet metal after which the limbs 17 are bent relative to root portion 18, and the supporting arms 13 are bent relative to limbs 17.

It will be apparent, from the construction so far described, that when the spring 16 formed by the limbs 17 is free from manual pressure, the pivot pins are in their closest position. In this position, the pins engage in the supporting lugs 11*a* of the shaving unit 11 to lock the unit to the razor handle and permit pivotal movement of the unit about the axis through the pivot pins. In this state, a further lug 11*b* on the shaving unit 11 engages an abutment 19 on the handle to apply torque to the unit about the pivot axis of the pins 12 in a sense opposite to that applied to the unit when it is pressed against the face of a user and moved in a shaving sense. The resistance to longitudinal bending in the limbs of the U-spring 16, or in other words the biassing force is spring 16 which urges the limbs 17 rearwardly, holds the further lug 11*b* against the abutment 19.

If the two limbs 17 of the U-spring 16 are pressed in a forward direction, the supporting arms 13 are urged forwardly until the inclined surfaces 13*b* on each of the arms engages the cam members 14,15, this engagement urges the arms 13 away from each other and so releases the pivot pins 12 from the supporting lugs 11*a* of the shaving unit.

In the embodiment illustrated in the drawings, a cover plate 20 overlies the two cams 14,15 and the supporting arms 13 to enclose the supporting arms within the head of the razor handle.

The cover plate 20 is suitably secured in position on the handle 10 by pins or lugs 21 which fit resiliently in recesses of the handle member 10.

In the illustrated embodiment, an operating button 22 fitted within an opening in the rear wall of the handle 10 is held in position by a leaf spring 23 integral with the U-spring 16 at its lower end. The upper ends of the limbs 17 of the U-spring 16 underlie the button 22 and the leaf spring 23, the limbs 17 having freedom for independent movement relative to the button 22 in planes perpendicular to the flat underside of the button 22. However, by pressing the button 22 in a forward direction, the upper ends of limbs 17 and hence the supporting arms 13 are urged forwardly against the return force of the spring 16, to release the blade unit from the pivot pins.

I claim:

1. A razor handle comprising a pair of co-linear oppositely-directed pivots for detachably supporting thereon a shaving unit of the pivotal type (said unit having one or more blades contained within a housing, and the housing having spaced pivot supports thereon for receiving a pair of pivots of a handle to support the shaving unit in the handle for pivotal movement about an axis containing said pivots), said handle further comprising a pair of spaced apart supporting arms carrying said pivots at the forward ends of the arms, spring means secured to the handle and connected to the rearward end of the arms and acting on each arm independently to urge it in a rearward direction and to oppose movement of the arms away from each other, cam means engageable with the respective arms and effective in a first sense to move the arms apart against the force of said spring means in response to forward movement of the arms relative to the cam means into a unit-released position and in a second sense to permit the arms to move towards each other into a unit-locked position under the return force of said spring means in response to rearward movement of the arms, at least one abutment on the handle offset from said axis and against which the unit in the locked position is spring-biassed by said spring means, the spring means permitting the unit to move pivotally about the said axis through the pivots and also about an axis transverse to a plane containing said arms.

2. A razor handle according to claim 1, wherein said spring means comprise two spaced apart resilient limbs rigidly secured at one end thereof to each other and a fixed portion of the handle and rigidly secured at the opposite end thereof to the respective arms.

3. A razor handle according to claim 2, wherein said resilient limbs form the sides of a U-shaped spring.

4. A razor handle according to claim 2, wherein the arms are integral with the respective resilient limbs and extend in a plane inclined to a plane containing the limbs.

5. A razor handle according to claim 4, wherein the spring bias of the spring means which urges the arms rearwardly is the resistance to longitudinal bending of the said limbs.

6. A razor handle according to claim 4, wherein the spring bias of the spring means which urges the arms towards each other is the resistance to bending of the said limbs.

* * * * *